US007388330B2

(12) United States Patent
Song et al.

(10) Patent No.: US 7,388,330 B2
(45) Date of Patent: Jun. 17, 2008

(54) PLASMA DISPLAY PANEL HAVING ELECTRODE SHORTED SEGMENT WITH ELECTRODE VOID REGIONS FORMED THEREIN

(75) Inventors: Young-Hwa Song, Suwon-si (KR); Seung-Heon Oh, Suwon-si (KR); Chang-Seok Rho, Suwon-si (KR); Cheol-Hee Moon, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 527 days.

(21) Appl. No.: 10/992,761

(22) Filed: Nov. 22, 2004

(65) Prior Publication Data

US 2005/0127837 A1 Jun. 16, 2005

(30) Foreign Application Priority Data

Nov. 26, 2003 (KR) ..... 10-2003-0084445

(51) Int. Cl.
*H01J 17/49* (2006.01)

(52) U.S. Cl. ..... 313/582; 313/583; 313/631; 313/326

(58) Field of Classification Search ..... None
See application file for complete search history.

(56) References Cited

U.S. PATENT DOCUMENTS 3,823,394 A * 7/1974 Byrum et al. ..... 365/116
6,856,305 B2 * 2/2005 Nagano ..... 345/60

FOREIGN PATENT DOCUMENTS

JP 06-203759 7/1994
JP 2000-053904 2/2000

* cited by examiner

*Primary Examiner*—Ashok Patel
(74) *Attorney, Agent, or Firm*—H.C. Park & Associates, PLC

(57) ABSTRACT

A display panel comprising a substrate, a plurality of first electrodes formed on a surface of the substrate and extending from a first portion of the substrate, and a plurality of second electrodes formed on the surface of the substrate and extending from a second portion of the substrate. The first electrodes and the second electrodes are alternately arranged in rows. The first electrodes include a shorted segment in the first portion of the substrate that couples ends of the first electrodes. The shorted segment includes an electrode formation region and electrode void regions. The electrode void regions are formed in a predetermined pattern in the electrode formation region.

19 Claims, 8 Drawing Sheets

PLASMA DISPLAY PANEL HAVING ELECTRODE SHORTED SEGMENT WITH ELECTRODE VOID REGIONS FORMED THEREIN

CROSS REFERENCE TO RELATED APPLICATION

This application claims priority to and the benefit of Korean Patent Application No. 10-2003-0084445, filed on Nov. 26, 2003, which is hereby incorporated by reference for all purposes as if fully set forth herein.

BACKGROUND OF THE INVENTION

1. Field of the Invention

The present invention relates to a plasma display panel (PDP). More particularly, the present invention relates to a PDP in which an electrode shorted segment has various configurations enabling its formation at a substantially uniform thickness.

2. Discussion of the Related Art

A PDP displays images through excitation of phosphors by plasma discharge. Specifically, an applied voltage between two electrodes in a discharge region of the PDP generates a plasma discharge between them. Ultraviolet rays generated during the plasma discharge excite phosphor layers to display images. The different types of PDPs include alternating current (AC) PDPs, direct current (DC) PDPs, and hybrid PDPs.

FIG. 5 shows a partial exploded perspective view of a conventional PDP 100. The conventional AC-PDP 100 includes a lower substrate 101 and an upper substrate 102 provided opposing one another with a predetermined gap therebetween. Address electrodes 103 are formed on a surface of the lower substrate 101 opposing the upper substrate 102. The address electrodes 103 are formed in a stripe pattern substantially along direction Y. A dielectric layer 105 is formed on the lower substrate 101 covering the address electrodes 103, and a plurality of barrier ribs 107 are formed on the dielectric layer 105. The barrier ribs 107 function to maintain the panel gap and prevent crosstalk between discharge cells. A phosphor layer 108 is formed between each adjacent pair of the barrier ribs 107 covering the dielectric layer 105 and side walls of the barrier ribs 107.

Formed on a surface of the upper substrate 102 opposing the lower substrate 101 are display electrodes 104. The display electrodes 104 are formed substantially along direction X, that is, substantially along a direction perpendicular to the address electrodes 103. The display electrodes 104 are formed such that a pair of the same is positioned over each of the discharge cells defined by the barrier ribs 107. A dielectric layer 106 and a protection layer 109 are formed on the upper substrate 102 covering the display electrodes 104.

In the conventional PDP with this configuration, each pair of the display electrodes 104 is comprised of a sustain electrode and a scanning electrode. A drive voltage is received from the address electrodes 103 and the scanning electrodes to thereby effect address discharge therebetween and form a wall charge on the dielectric layer 105. Sustain discharge is effected between the sustain electrodes and the scanning electrodes in the discharge cell selected by the address discharge by a signal that is alternatingly supplied to the sustain electrodes and the scanning electrodes.

Accordingly, a discharge gas filled in the discharge region where the discharge cells are formed is excited such that the discharge gas generates ultraviolet rays. Visible light is generated by the excitation of the phosphors of the phosphor layers by the ultraviolet rays, thereby resulting in the formation of images.

A silver (Ag) paste is typically used to form sustain electrodes and scanning electrodes, as well as address electrodes. A screen printing or photolithography process is typically used to form these electrodes since they may be formed at widths of 70 to 80 μm. Lift-off and thin film methods are other possible alternatives. However, these conventional methods for forming electrodes may not be suitable when manufacturing large screen PDPs. Therefore, an offset printing process method is being explored, which may be used to precisely and stably print electrodes.

FIG. 6 is a schematic sectional view showing sequential steps of the offset printing process.

The offset printing process generally involves the main steps of paste deposition and doctoring, step A, an off process, step B, and a set process, step C. Step A involves depositing a paste 23 on an intaglio 21 having a plurality of indented grooves. A doctor blade 22 is scraped along the intaglio 21 in a direction (a doctoring direction) to remove excess paste 23, leaving paste 23 in the indented grooves. Next, in step B, a blanket 24 (partially shown), which may be made of silicone rubber and cylindrical in shape, is used to remove the paste from the indented grooves of the intaglio 21. Finally, in step C, the blanket 24 and the paste 23 are pressed against a substrate 25 to transfer the paste 23 onto the substrate 25.

However, the offset printing process may have drawbacks. Although this process may effectively form small and narrow electrode portions, when forming large electrode portions, such as terminal electrodes, problems may be encountered during the doctoring process since that process may be best suited for forming long and narrow electrode sections that extend along the doctoring direction. Hence, large electrode portions formed by the offset printing process may not meet desired quality standards.

FIG. 7 and FIG. 8 show problems with the conventional offset printing process just described.

FIG. 7 is a partial perspective view showing an intaglio 21 with a paste 23 formed thereon following an offset printing process. A doctor blade (not shown) was run across the intaglio 21 in a doctoring direction, as indicated in FIG. 7, to remove excess portions of the previously deposited paste 23.

FIG. 8 is a schematic sectional view showing the sequential steps involved in the offset printing process when forming shorted segments of sustain electrodes. The views are taken along line I-I of FIG. 7.

In step A of FIG. 8, after depositing the paste 23 on the intaglio 21, the doctor blade 22 is used to remove the overflow paste. At the beginning of the doctoring process, the remaining paste 23 is substantially coplanar with an upper surface of the intaglio 21. However, as shown in step B, as the doctor blade 22 progresses along the doctoring direction, it may enter a region where it no longer contacts the intaglio's upper surface, and the doctor blade 22 may descend into the intaglio's indented groove. This situation may continue as the doctor blade 22 further progresses along the doctoring direction, as shown in step C. At the end of doctoring process, as shown in step D, a middle portion of the paste 23 may be concave.

When transferring the paste 23 with the concave middle portion onto a substrate using a blanket to form sustain electrode shorted segments, the shorted segments may not be uniformly thick. The end result is that discharge characteristics of the PDP may be adversely affected by the uneven thickness of the shorted segments.

SUMMARY OF THE INVENTION

The present invention provides a PDP having shorted segments of sustain electrodes of a substantially uniform thickness, thereby improving the PDP's discharge characteristics.

Additional features of the invention will be set forth in the description which follows, and in part will be apparent from the description, or may be learned by practice of the invention.

The present invention discloses a PDP comprising a substrate, a plurality of first electrodes formed on a surface of the substrate and extending from a first portion of the substrate, and a plurality of second electrodes formed on the surface of the substrate and extending from a second portion of the substrate. The first electrodes and the second electrodes are alternately arranged in rows. The first electrodes include a shorted segment in the first portion of the substrate that couples ends of the first electrodes. The shorted segment includes an electrode formation region and electrode void regions. The electrode void regions are formed in a predetermined pattern in the electrode formation region.

The present invention also discloses an apparatus for coupling a plurality of electrodes, comprising a shorted segment coupling ends of a plurality of electrodes. The shorted segment includes an electrode formation region and electrode void regions, and the electrode void regions are formed in a predetermined pattern in the electrode formation region.

The present invention also discloses a method for forming commonly coupled electrodes, comprising forming an intaglio having indented grooves, depositing a paste into the indented grooves, doctoring the deposited paste, removing the paste from the indented grooves, and transferring the paste onto a substrate in a shape corresponding to the indented grooves. The indented grooves correspond to a shape of the commonly coupled electrodes, and a first portion of the indented grooves corresponds to a shape of a shorted segment of the commonly coupled electrodes. The first portion includes islands of upper surface areas of the intaglio corresponding to electrode void regions in the shorted segment, and the islands of upper surface areas are formed in a predetermined pattern.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION

Figure 1:
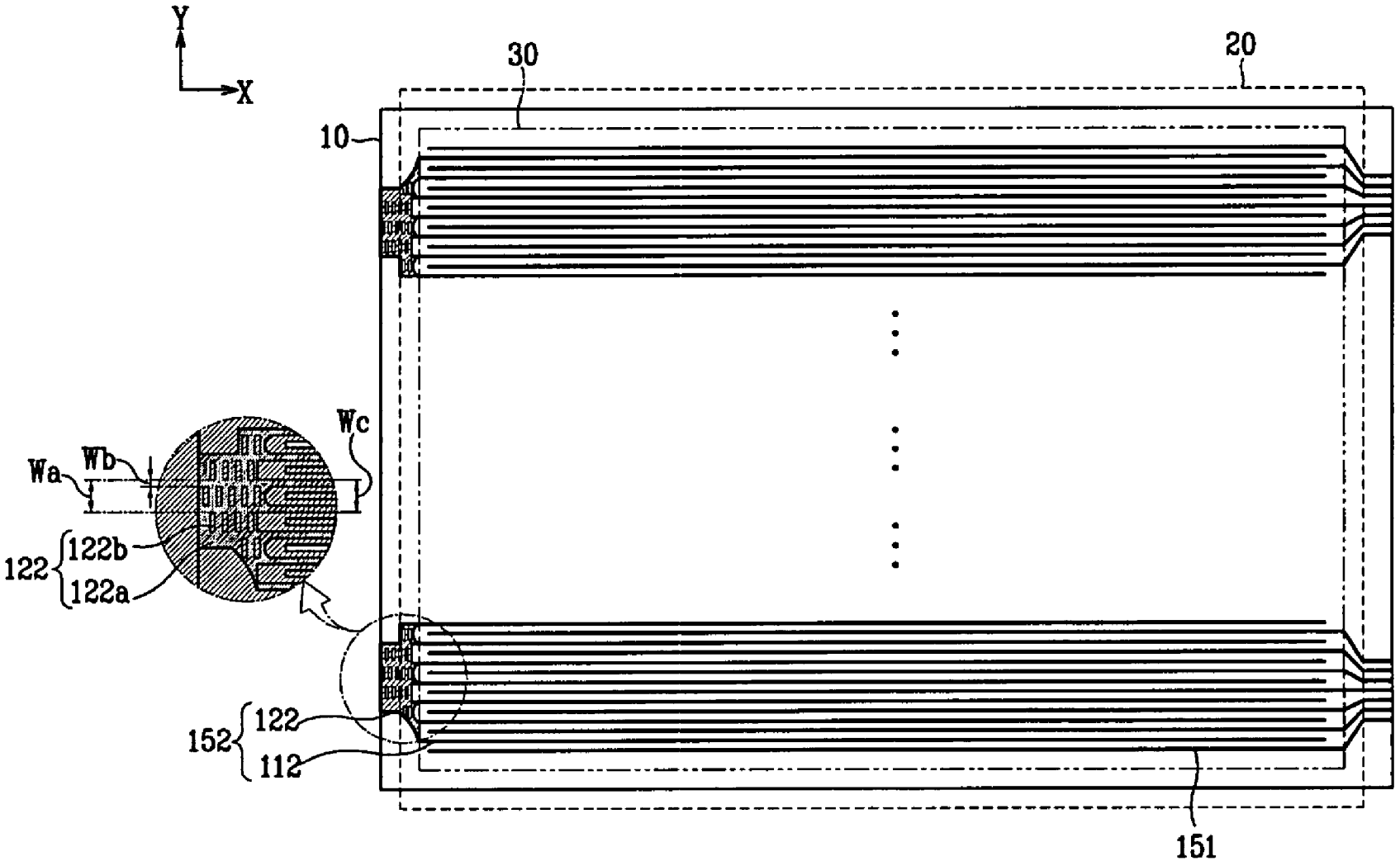
FIG. 1 is a plan view showing a PDP according to a first exemplary embodiment of the present invention.

FIG. 1 is a plan view of a PDP according to a first exemplary embodiment of the present invention.

Referring to FIG. 1, a plurality of display electrodes 151, 152 are formed on a first substrate 10 substantially along direction X. The display electrodes 151, 152 comprise sustain electrodes 152, which extend from one edge of the first substrate 10, and scanning electrodes 151, which extend from the opposite edge of the first substrate 10. As shown in FIG. 1, the sustain electrodes 152 and the scanning electrodes 151 are alternately arranged in rows.

A plurality of address electrodes (not shown) are formed on a surface of the second substrate 20, which is joined together with the first substrate 10. The address electrodes are formed substantially perpendicular to the display electrodes 151, 152. In other words, the address electrodes extend substantially along direction Y.

A display region 30 comprises pixels formed at areas where the address electrodes and the display electrodes 151, 152 overlap. Drive voltages may be applied to the address electrodes and the display electrodes 151, 152 to generate a display discharge.

A plurality of barrier ribs (not shown) may be formed between the first and second substrates 10, 20 in the display region 30. The barrier ribs maintain a gap between the substrates and define discharge cells. A phosphor layer may be formed in the discharge cells.

A non-display region, in which display discharges do not take place, is formed outside of the display region 30. Display electrode terminals may be formed in the non-display region, and they may be coupled to a drive circuit (not shown) through an electrical coupling means such as an FPC (flexible printed circuit).

The sustain electrodes 152 include effective segments 112, which are positioned within the display region 30, and a plurality of shorted segments 122, which may be positioned in the non-display region, that couple ends of a plurality of the effective segments 112. Since the ends of the sustain electrodes 152 are shorted in this manner, the same voltage may be applied to the sustain electrodes 152 during a sustain interval.

In the first exemplary embodiment, each of the shorted segments 122 includes an electrode formation region **122*a* and electrode void regions 122*b*, which may be formed in a predetermined pattern in the electrode formation region 122*a*. The electrode void regions 122*b* may be formed independently (i.e., not contacting each other) within the electrode formation region 122*a*. In other words, the electrode void regions 122*b* may be formed as islands in the electrode formation region 122*a*. In this exemplary embodiment, the electrode void regions 122*b*** are substantially rectangular.

The electrode void regions **122*b* may be formed in columns substantially along the X direction, which is the direction the sustain electrodes 152 extend. The electrode void regions 122***b* of adjacent columns are not aligned in the Y direction, however, electrode void regions 122*b* of every other column may be aligned in the Y direction. $W_a$ is a distance between two electrode void regions 122*b* that are aligned in the Y direction. $W_a$ may be equal to, less than, or greater than a distance $W_c$, in the Y direction, which is the distance between two adjacent effective segments 112 plus their widths.

Further, a distance $W_b$, along the Y direction, between adjacent columns of the electrode void regions 122*b* may range from 20 μm to 10,000 μm.

Figure 2:
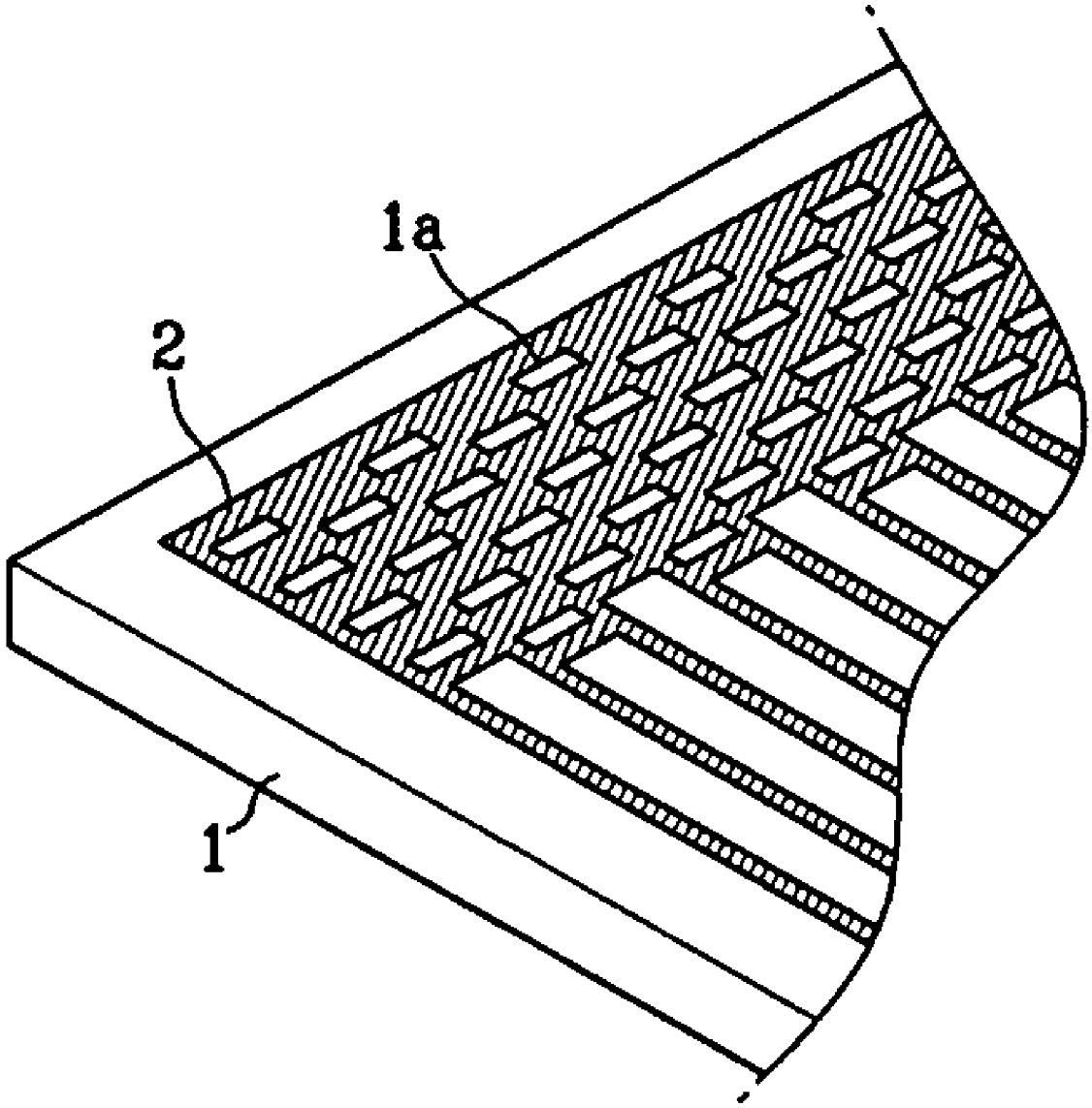
FIG. 2 is a partial perspective view showing an intaglio having a paste used for forming electrodes by an offset printing process.

The sustain electrodes 152 may be formed using an offset printing process. FIG. 2 is a partial perspective view showing an intaglio having a paste used for forming electrodes through an offset printing process.

Figure 8:
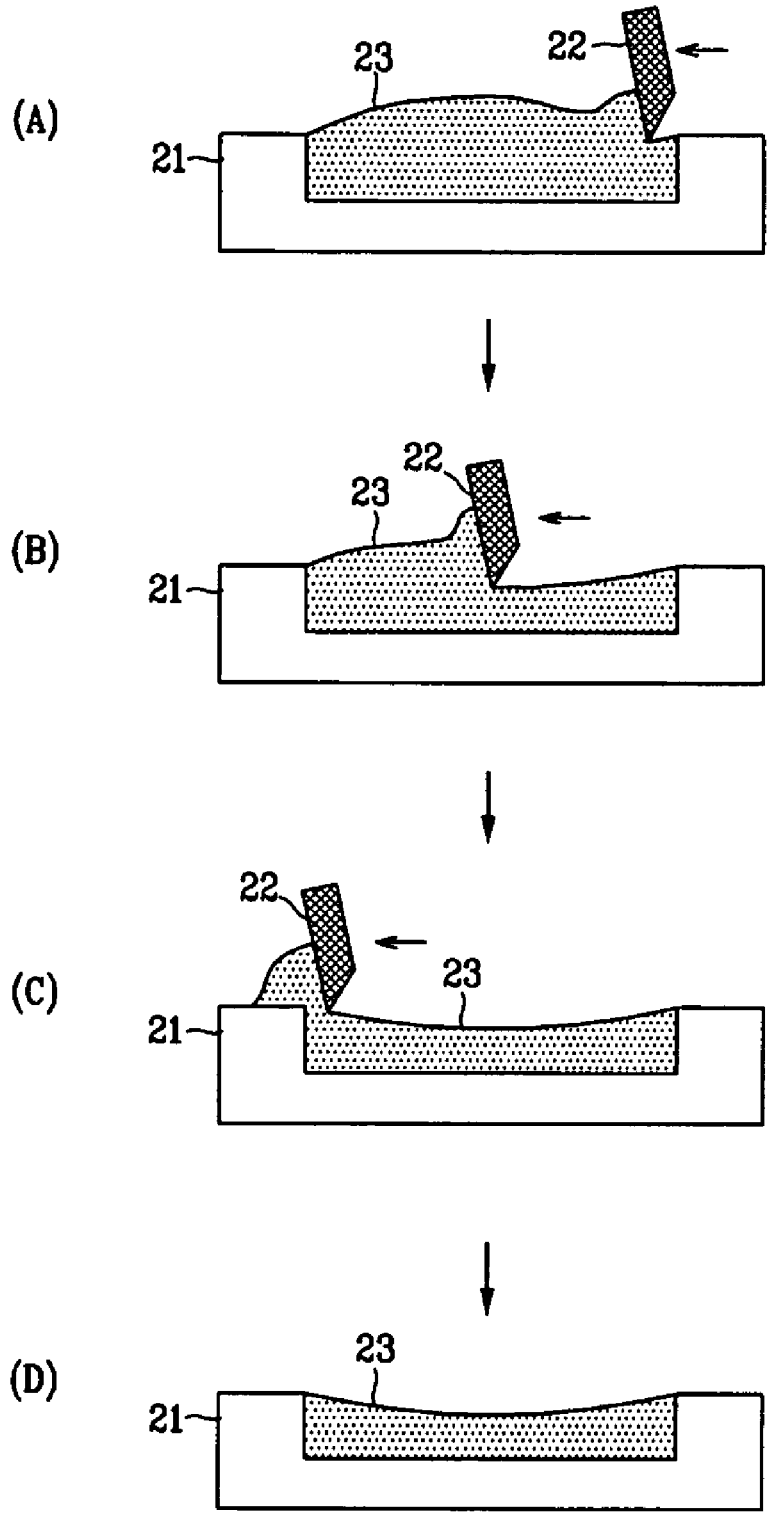
FIG.8(Prior Art)
FIG. 8 is a schematic sectional view, taken along line I-I of FIG. 7, showing steps involved in an offset printing process when forming shorted segments of sustain electrodes.

Referring to FIG. 2, an intaglio 1 is formed with indented grooves corresponding to a shape of the sustain electrodes 152 that will be formed on the first substrate 10. A paste 2 is deposited in the indented grooves, and then a doctor blade (not shown) is used to remove excess paste. The indented grooves are formed corresponding to the shapes of the effective segments 112 and the shorted segments 122. Islands of upper surface areas 1*a* of the intaglio 1 correspond to the desired pattern of the electrode void regions 122*b*. This configuration may permit the doctor blade to always remain in contact with the upper surface areas 1*a* of the intaglio 1, which prevents the blade from descending into the indented grooves, as with the case shown in FIG. 8, thereby preventing shorted segments from being formed with a concave cross-section. Therefore, when the paste 2 is transferred onto a blanket, and then onto the substrate 10, the electrode formation region 122*a* may be formed having a substantially uniform thickness.

Figure 3:
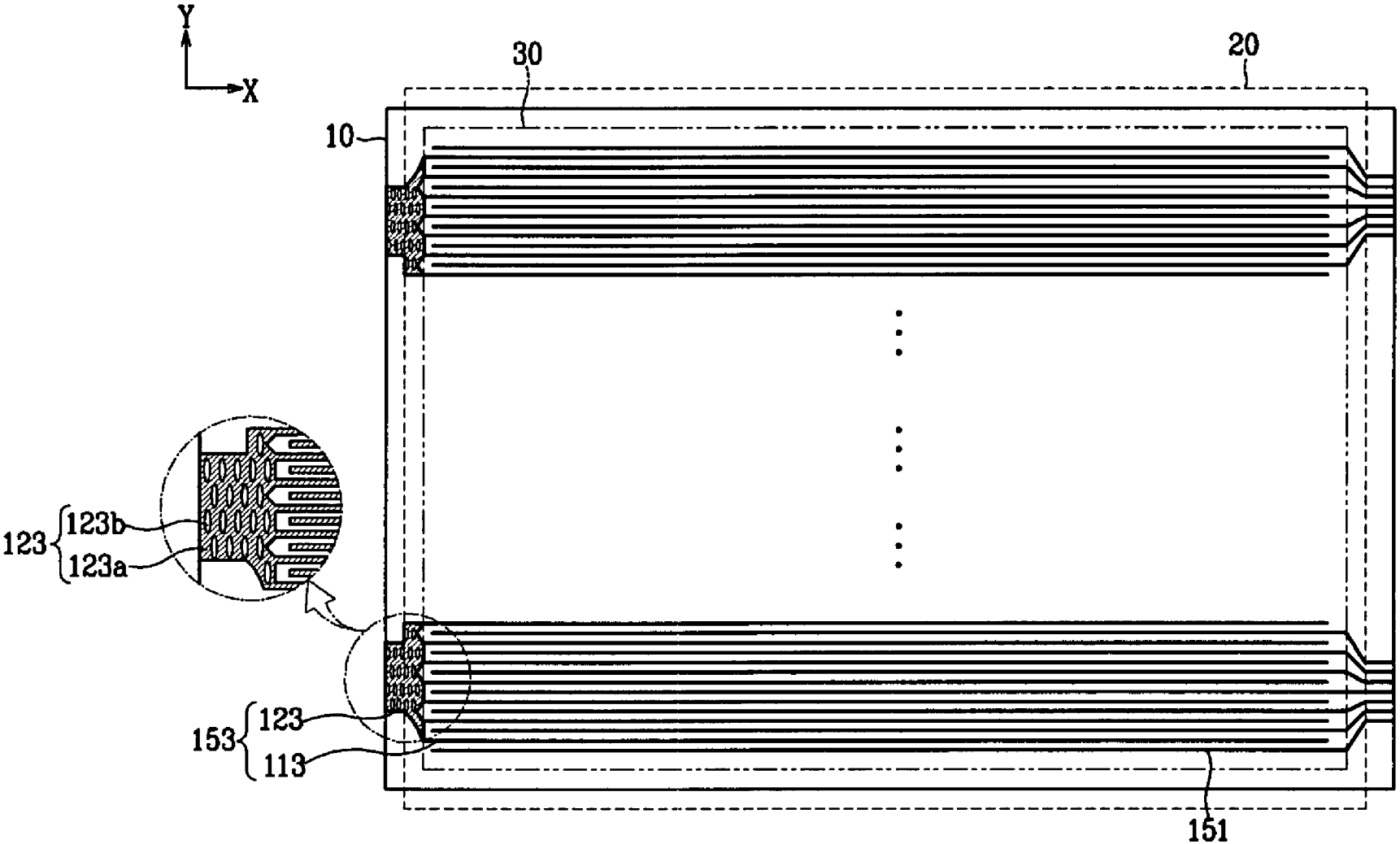
FIG. 3 is a plan view showing a PDP according to a second exemplary embodiment of the present invention.

FIG. 3 is a plan view showing a PDP according to a second exemplary embodiment of the present invention.

Referring to FIG. 3, a plurality of display electrodes 151, 153 are formed on a first substrate 10 substantially along direction X. The display electrodes 151, 153 comprise sustain electrodes 153, which extend from one edge of the first substrate 10, and scanning electrodes 151, which extend from the opposite edge of the first substrate 10. As shown in FIG. 3, the sustain electrodes 153 and the scanning electrodes 151 are alternately arranged in rows.

The sustain electrodes 153 include effective segments 113, which are positioned within the display region 30, and a plurality of shorted segments 123, which may be positioned in a non-display region, that couple ends of a plurality of the effective segments 113. Since the ends of the sustain electrodes 153 are shorted in this manner, the same voltage may be applied to the sustain electrodes 153 during a sustain interval.

In the second exemplary embodiment, each of the shorted segments 123 includes an electrode formation region 123*a* and electrode void regions 123*b*, which may be formed in a predetermined pattern in the electrode formation region 123*a*. The electrode void regions 123*b* may be formed independently (i.e., not contacting each other) within the electrode formation region 123*a*. In other words, the electrode void regions 123*b* may be formed as islands in the electrode formation region 123*a*. In this exemplary embodiment, the electrode void regions 123*b* are substantially circular, which includes an oval shape.

Figure 4:
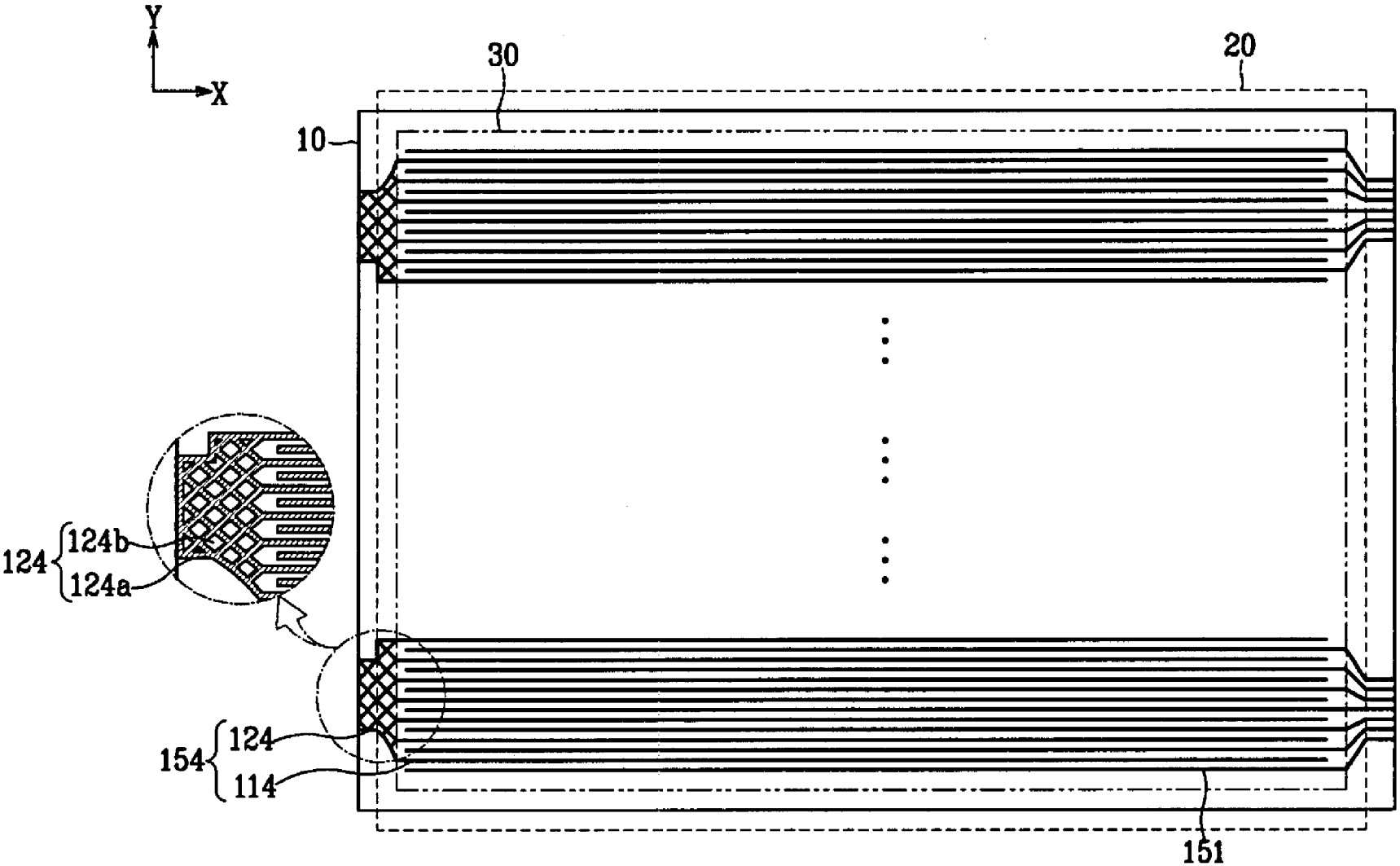
FIG. 4 is a plan view showing a PDP according to a third exemplary embodiment of the present invention.
Figure 5:
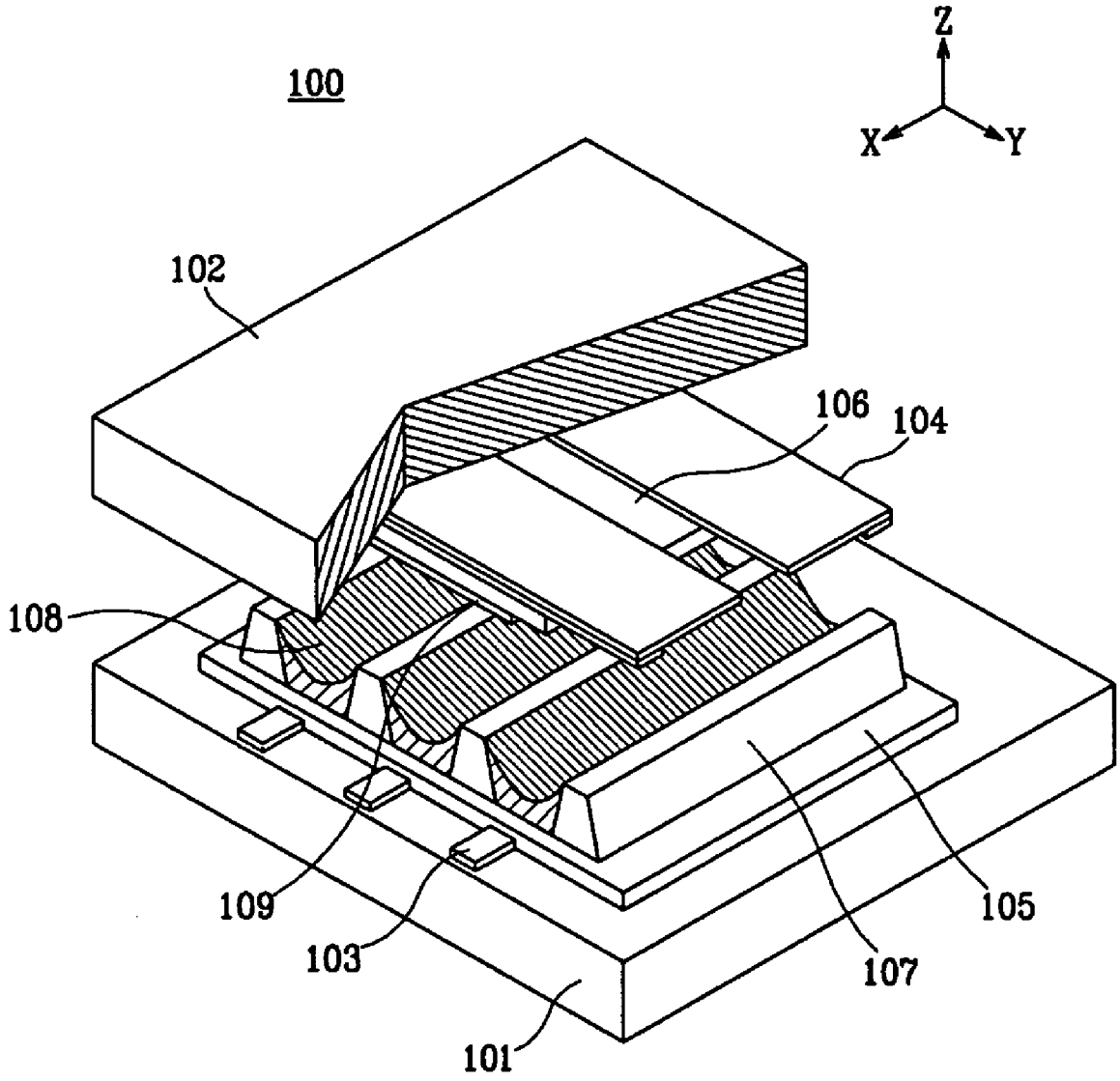
FIG. 5(Prior Art)
FIG. 5 is a partial exploded perspective view of a conventional PDP.
Figure 6:
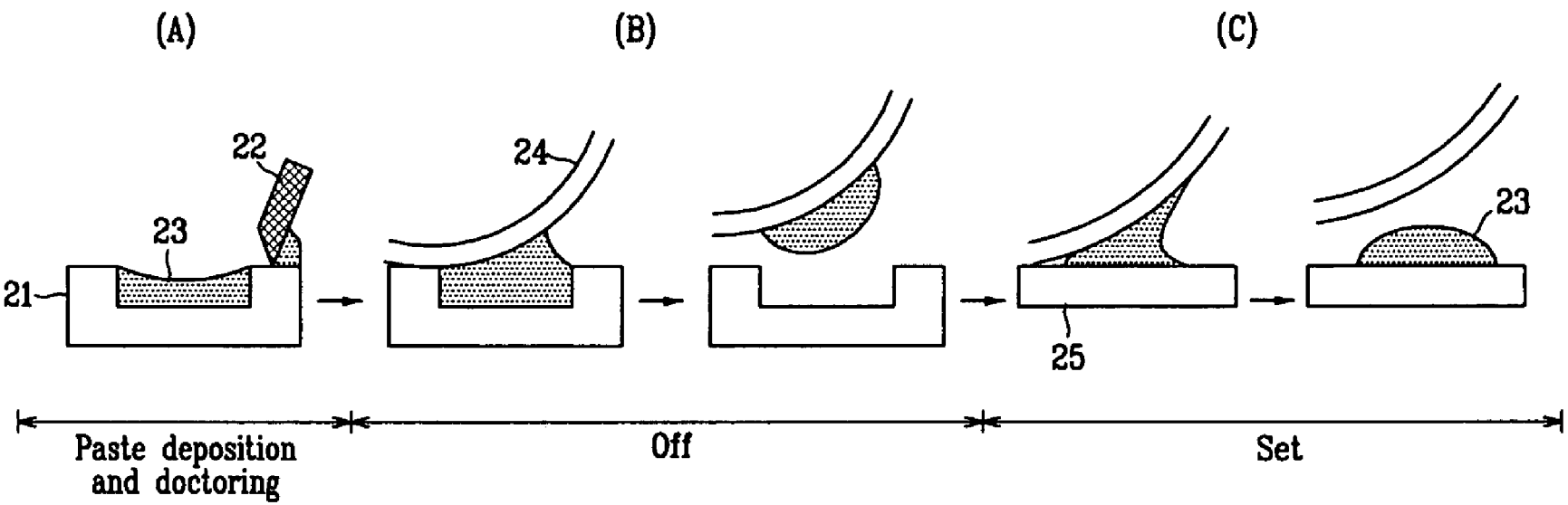
FIG. 6(Prior Art)
FIG. 6 is schematic sectional view generally showing an offset printing process.
Figure 7:
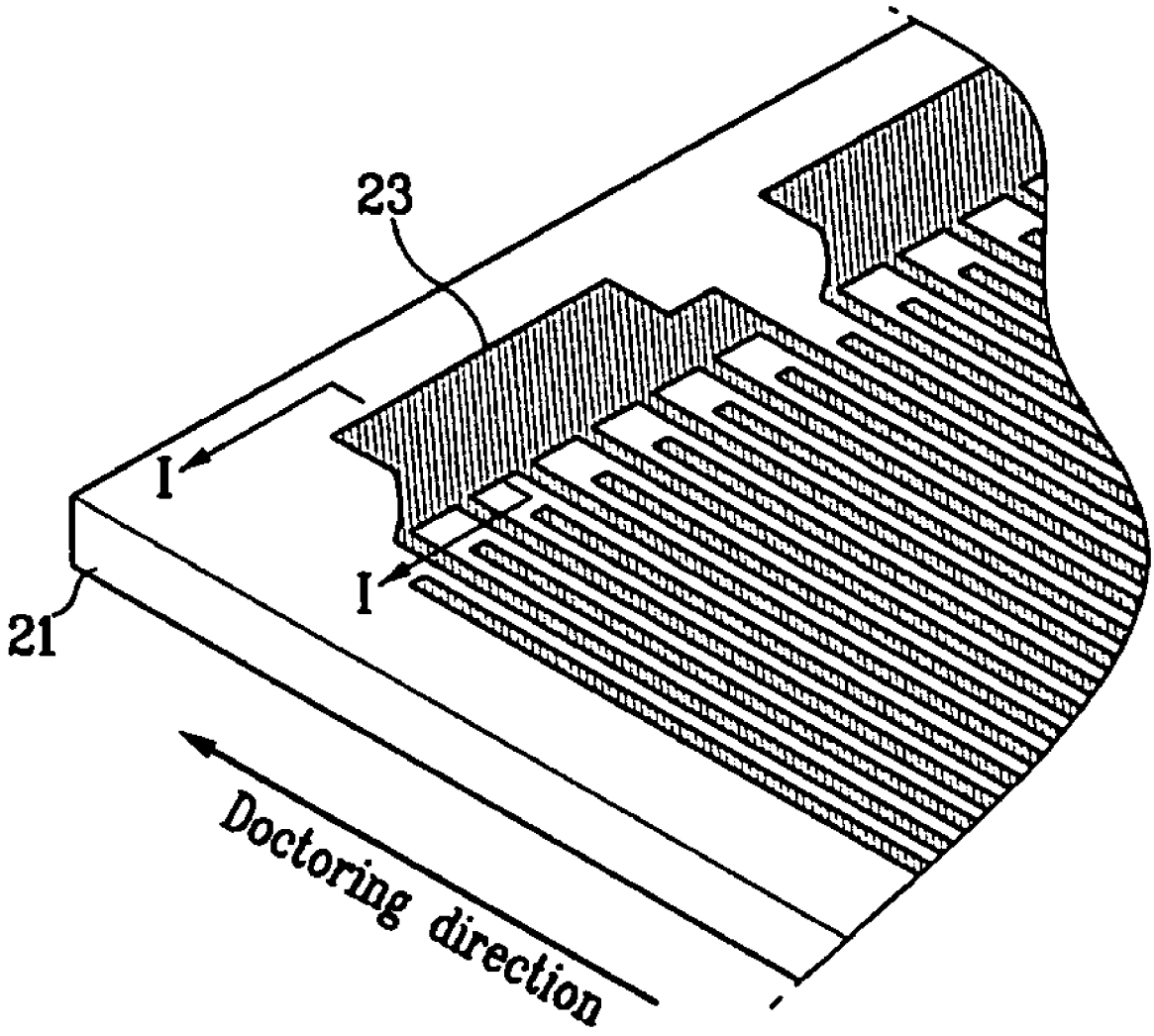
FIG. 7(Prior Art)
FIG. 7 is a partial perspective view showing an intaglio with a paste formed thereon following an offset printing process.

FIG. 4 is a plan view showing a PDP according to a third exemplary embodiment of the present invention.

Referring to FIG. 4, a plurality of display electrodes 151, 154 are formed on a first substrate 10 substantially along direction X. The display electrodes 151, 154 comprise sustain electrodes 154, which extend from one edge of the first substrate 10, and scanning electrodes 151, which extend from the opposite edge of the first substrate 10. As shown in FIG. 4, the sustain electrodes 154 and the scanning electrodes 151 are alternately arranged in rows.

The sustain electrodes 154 include effective segments 114, which are positioned within the display region 30, and a plurality of shorted segments 124, which may be positioned in a non-display region, that couple ends of a plurality of the effective segments 114. Since the ends of the sustain electrodes 154 are shorted in this manner, the same voltage may be applied to the sustain electrodes 154 during a sustain interval.

In this third exemplary embodiment, each of the shorted segments 124 includes an electrode formation region 124*a* and electrode void regions 124*b*, which may be formed in a predetermined pattern in the electrode formation region 124*a*. The electrode void regions 124*b* may be formed independently (i.e., not contacting each other) within the electrode formation region 124*a*. In other words, the electrode void regions 124*b* may be formed as islands in the electrode formation region 124*a*. In this exemplary embodiment, the electrode void regions 124*b* are substantially diamond-shaped.

In a PDP as described above, sustain electrode shorted segments may be formed in a manner that is conducive to the offset printing process. That is, the electrode void regions of the shorted segments may be formed in a pattern that allows the doctor blade to continually contact the intaglio's upper surface areas so that it does not sink into the indented grooves during the doctoring step. Therefore, the paste may be prevented from having a concave cross section, which may ultimately lead to electrode formation regions of the shorted segments having a substantially uniform thickness. Another advantage of such a configuration of the sustain electrodes may be that less paste may be used to form the electrodes as a result of the structure of the shorted segments.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising:

a substrate;

a plurality of first electrodes formed on a surface of the substrate and extending from a first portion of the substrate; and a plurality of second electrodes formed on the surface of the substrate and extending from a second portion of the substrate, wherein the first electrodes and the second electrodes are alternately arranged in rows;

wherein the first electrodes include a shorted segment in the first portion of the substrate that couples ends of the first electrodes, and ends of the second electrodes are not coupled to the ends of the first electrodes;

wherein the shorted segment includes an electrode formation region and electrode void regions; and wherein at least two electrode void regions are arranged along a single line extending parallel with an extending direction of the first electrodes.

2. The PDP of claim 1, wherein the electrode void regions are formed in columns substantially aligned along a direction the first electrodes extend; and wherein portions of the electrode formation region are provided between the electrode void regions.

3. The PDP of claim 1, wherein the electrode void regions are formed as islands.

4. The PDP of claim 3, wherein the electrode void regions are substantially rectangular.

5. The PDP of claim 3, wherein the electrode void regions are substantially circular.

6. The PDP of claim 3, wherein the electrode void regions are substantially diamond-shaped.

7. The PDP of claim 1, wherein the electrode void regions are formed in columns substantially aligned along a direction the first electrodes extend;

wherein electrode void regions of every other column are substantially aligned along a direction that is substantially perpendicular to the direction the first electrodes extend; and wherein a distance between two substantially aligned electrode void regions along the direction that is substantially perpendicular to the direction the first electrodes extend is equal to or less than a distance between two adjacent first electrodes plus their widths.

8. The PDP of claim 1, wherein the electrode void regions are formed in columns substantially aligned along a direction the first electrodes extend;

wherein electrode void regions of every other column are substantially aligned along a direction that is substantially perpendicular to the direction the first electrodes extend; and wherein a distance between two substantially aligned electrode void regions along the direction that is substantially perpendicular to the direction the first electrodes extend is greater than a distance between two adjacent first electrodes plus their widths.

9. The PDP of claim 1, wherein the electrode void regions are formed in columns substantially aligned along a direction the first electrodes extend; and wherein a distance between adjacent columns in a direction substantially perpendicular to the direction the first electrodes extend is in a range of 20 μm to 10,000 μm.

10. The PDP of claim 1, wherein the first electrodes are formed using an offset printing process.

11. The PDP of claim 1, wherein every electrode void region is completely surrounded by the electrode formation region.

12. The PDP of claim 2, wherein a single column of electrode void regions comprises at least three electrode void regions, the single column being aligned along the extending direction of the first electrodes.

13. An apparatus for coupling a plurality of electrodes, comprising:

a shorted segment coupling ends of a plurality of electrodes, wherein the shorted segment includes an electrode formation region and electrode void regions; and wherein each electrode void region is completely surrounded by the electrode formation region, and a single column of electrode void regions comprises a plurality of electrode void regions, the single column being aligned along a direction a single electrode extends.

14. The apparatus of claim 13, wherein the electrode void regions are substantially rectangular.

15. The apparatus of claim 13, wherein the electrode void regions are substantially circular.

16. The apparatus of claim 13, wherein the electrode void regions are substantially diamond-shaped.

17. The apparatus of claim 13, wherein a distance between adjacent columns in a direction substantially perpendicular to the direction the electrodes extend is in a range of 20 μm to 10,000 μm.

18. The apparatus of claim 13, wherein the shorted segment is formed using an offset printing process.

19. The PDP of claim 13, wherein the single column of electrode void regions comprises at least three electrode void regions.

* * * * *